US007207787B2

(12) United States Patent
Liang et al.

(10) Patent No.: US 7,207,787 B2
(45) Date of Patent: Apr. 24, 2007

(54) SCROLL COMPRESSOR WITH BACKFLOW-PROOF MECHANISM

(75) Inventors: Kun-Yi Liang, Hsinchu (TW); Shu-Er Huang, Hsinchu (TW); Ching-Feng Lai, Taichung (TW); Yu-Choung Chang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 173 days.

(21) Appl. No.: 10/892,287

(22) Filed: Jul. 16, 2004

(65) Prior Publication Data

US 2005/0142017 A1 Jun. 30, 2005

(30) Foreign Application Priority Data

Dec. 25, 2003 (TW) ..... 92136825 A

(51) Int. Cl.
*F01C 1/00* (2006.01)

(52) U.S. Cl. ..... 418/55.1; 418/180; 418/189; 417/310; 417/440

(58) Field of Classification Search ..... 418/55.1, 418/55.2, 55.3, 55.4, 55.5, 270, 180, 189; 417/307, 310, 440
See application file for complete search history.

(56) References Cited

U.S. PATENT DOCUMENTS

| | | | | |
|---|---|---|---|---|
| 5,362,210 | A * | 11/1994 | Richardson, Jr. | 417/307 |
| 6,059,549 | A | 5/2000 | Tarng et al. | |
| 6,095,765 | A * | 8/2000 | Khalifa | 417/310 |
| 6,190,138 | B1 * | 2/2001 | Hugenroth et al. | 417/310 |
| 6,220,839 | B1 | 4/2001 | Sheridan et al. | |
| 6,267,565 | B1 * | 7/2001 | Seibel et al. | 417/292 |

* cited by examiner

*Primary Examiner*—Hoang Nguyen
(74) *Attorney, Agent, or Firm*—Birch, Stewart, Kolasch & Birch, LLP

(57) ABSTRACT

A scroll compressor with a backflow-proof mechanism. The scroll compressor comprises a slider disposed on a scroll couple, forming several enclosed spaces. The slider is raised by the working fluid in the spaces, preventing liquid leakage from a high-pressure chamber to a low-pressure chamber, when the scroll compressor starts. The slider descends when the compression ratio of the scroll compressor is exceeded. Thus, the pressure is released, and the performance of the scroll compressor is improved. The slider of the invention further comprises a floating element to prevent reversal of pressurized fluid and damage to the scroll couple.

31 Claims, 10 Drawing Sheets

SCROLL COMPRESSOR WITH BACKFLOW-PROOF MECHANISM

This Non-provisional application claims priority under 35 U.S.C. § 119(a) on Patent Application No(s). 092136825 filed in Taiwan, Republic of China on Dec. 25, 2003, the entire contents of which are hereby incorporated by reference.

BACKGROUND

The present invention relates to a scroll compressor, and in particular to a scroll compressor with mechanisms for adjusting load and preventing damage due to backflow.

Presently, scroll compressors must rapidly establish a high pressure when starting, have less backflow when stopped, and provide self-adjustment of operating pressure to prevent damage to scrolls, due to exceeded compression ratio.

In U.S. Pat. No. 6,059,549, Tarng, et al. teach a scroll compressor with a sealing arrangement. The scroll compressor comprises a partition dividing the shell thereof into a high-pressure chamber and a low-pressure chamber with a scroll couple therein. A spring and sealing ring are disposed in a hub portion of a fixed scroll, forming a buffer space therebetween. When the scroll compressor starts, the sealing ring is raised by the work flow corresponding to the spring, abutting the bottom surface of a partition. Thus, the sealing ring prevents leakage of the work fluid and achieves required operational pressure rapidly. Due to the additional spring, the sealing ring, however, is forced upwards and unable to descend and release operational pressure in the scroll couple when the compression ratio is exceeded. Therefore, the scroll compressor is unreliable.

In the above arrangement, compressed work fluid poured into the high-pressure chamber immediately reverses into the scroll couple when the scroll compressor stops. This backflow problem generates impact, noise and damage to the end portions of each scroll, thus shortening the life of the scroll compressor.

Furthermore, conventional scroll compressors must keep running when recycling refrigerant. The space between the scroll couple approaches a vacuum, and gas, or gasiform refrigerant, therein is ionized and discharges electricity, damaging the scroll couple.

SUMMARY

Accordingly, embodiments of the invention provide a scroll compressor with a pressure adjustment mechanism, capable of releasing load and allowing refrigerant to flow from the high-pressure to the low-pressure chamber when the compression ratio is exceeded.

Embodiments of the invention additionally provide a scroll compressor with backflow-proof mechanism, preventing damage due to backflow when the compressor stops.

Embodiments of the invention further prevent discharge between the scroll couple when recycling refrigerant.

Embodiments of the invention provide a scroll compressor with a backflow-proof mechanism. The scroll compressor comprises a partition, a scroll couple, and a slider disposed thereon. An inner space is defined between a shell of the scroll compressor and a frame therein. A partition with a central hole is disposed in the inner space, forming a high-pressure chamber and a low-pressure chamber. The scroll couple is disposed in the low-pressure chamber on the frame and comprises an orbiting scroll meshed with a non-orbiting scroll. The slider is movably disposed on the non-orbiting scroll and comprises an extending portion with a venting passage therein. The extending portion protrudes into the high-pressure chamber through the central hole, connecting the high-pressure chamber and the scroll couple through the venting passage. A plurality of enclosed spaces are formed between the slider and the non-orbiting scroll, such that the slider can move between a first position and a second position by the pressure variation of the enclosed spaces.

Furthermore, the non-orbiting scroll comprises a hub portion, receiving the slider. The hub portion comprises a first cavity and a second cavity beneath the first cavity. The diameter of the first cavity is larger than the diameter of the second cavity. The slider comprises a first portion and a second portion. The diameter of the first portion is larger than that of the extending portion and the second portion. When the slider is disposed in the hub portion, the first portion is received in the first cavity, and the second portion is received in the second cavity, forming the enclosed spaces therebetween.

The partition of the scroll compressor comprises a plurality of discharge passages around the side surface of the central hole, allowing communication between the high-pressure chamber and the low-pressure chamber. The slider comprises a circular leak-proof surface surrounding the outer bore of the extending portion, sealing the discharge passages when the slider is in the first position and abuts the partition. The extending portion of the slider comprises a plurality of holes on the side surface of the venting passage, allowing communication between the high-pressure chamber and the venting passage.

Embodiments of the invention provide another scroll compressor comprising a slider with a floating element movably disposed in a venting passage. The slider comprises a flange around the side surface of the venting passage, restricting the floating element therein. The floating element comprises a groove and a plurality of perpendicular second holes communicated therewith to balance the pressure difference between the high-pressure and low-pressure chambers. The extending portion comprises a upper hole at the top end and communicated with the venting passage. When the scroll compressor stops, work fluid in the high-pressure chamber reverses into the venting passage through the upper hole and pushes the floating element down to abut the flange. Simultaneously, the floating element blocks the venting passage, preventing damage due to the high-pressure work fluid.

The slider comprises a plurality of leak-proof members around the outer bore thereof, abutting the inner surface of the hub portion. The leak-proof members are O-rings or Teflon rings. The non-orbiting scroll further comprises a plurality of bypasses communicated with the first cavity. When the scroll compressor starts, work fluid passing through the bypasses fills the enclosed space in the first cavity, raising the slider.

Embodiments of the invention provide another scroll compressor with a backflow-proof mechanism. The scroll compressor comprises a partition, a scroll couple, and a slider disposed thereon. An inner space is defined between a shell of the scroll compressor and a frame therein. A partition with a central hole is disposed in the inner space, forming a high-pressure chamber and a low-pressure chamber. The scroll couple is disposed in the low-pressure chamber on the frame and comprises an orbiting scroll and a non-orbiting scroll with a hub portion. The slider is movably disposed in the hub portion of the non-orbiting scroll and comprises an extending portion with a venting passage therein.

The extending portion comprises a plurality of holes on the side surface of the venting passage and protrudes into the high-pressure chamber through the central hole, allowing communication between the high-pressure chamber and the scroll couple through the venting passage when the slider is in a first position. The partition covers the holes on the extending portion when the scroll compressor stops with the slider in a second position.

A plurality of enclosed spaces are formed between the slider and the non-orbiting scroll, such that the slider is moved between the first and second positions by the pressure variation of the enclosed spaces.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

First Embodiment

Figure 1A:
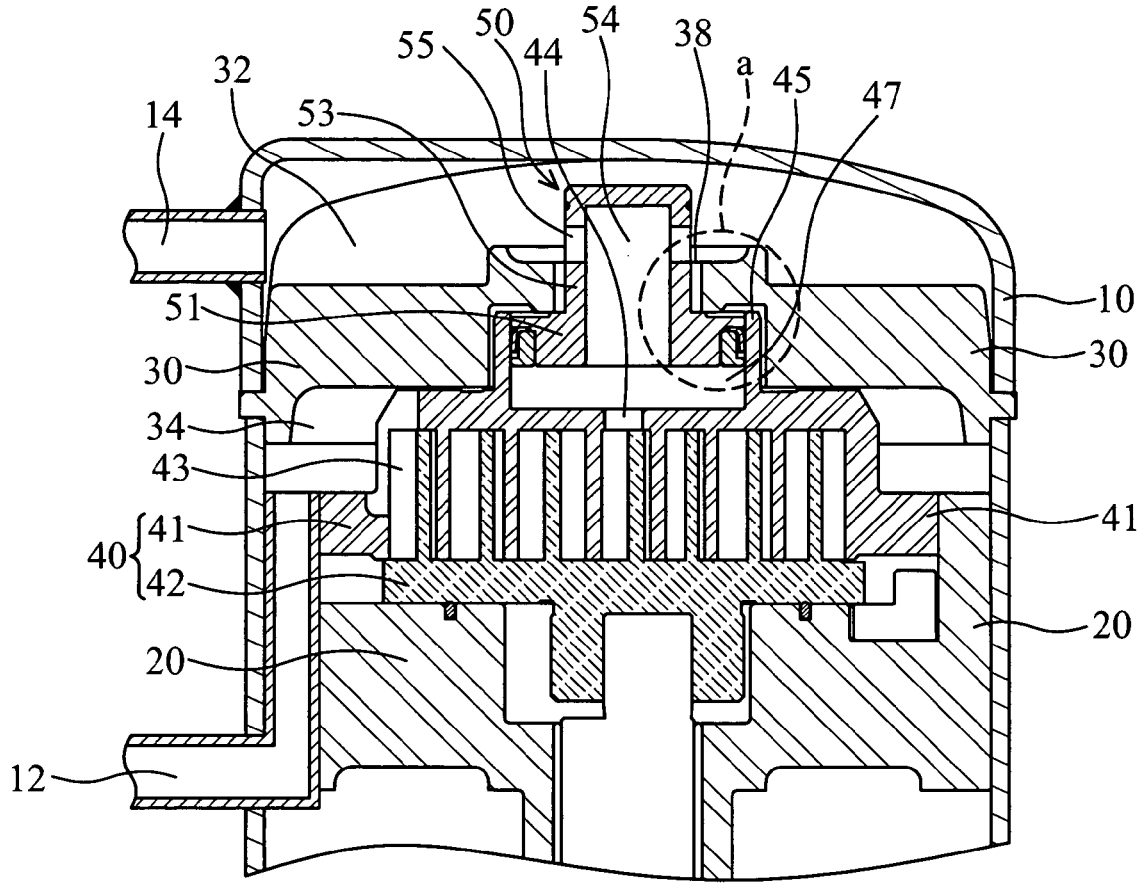
FIG. 1A is a partial cross section of a scroll compressor of the first embodiment during operation.
Figure 1B:
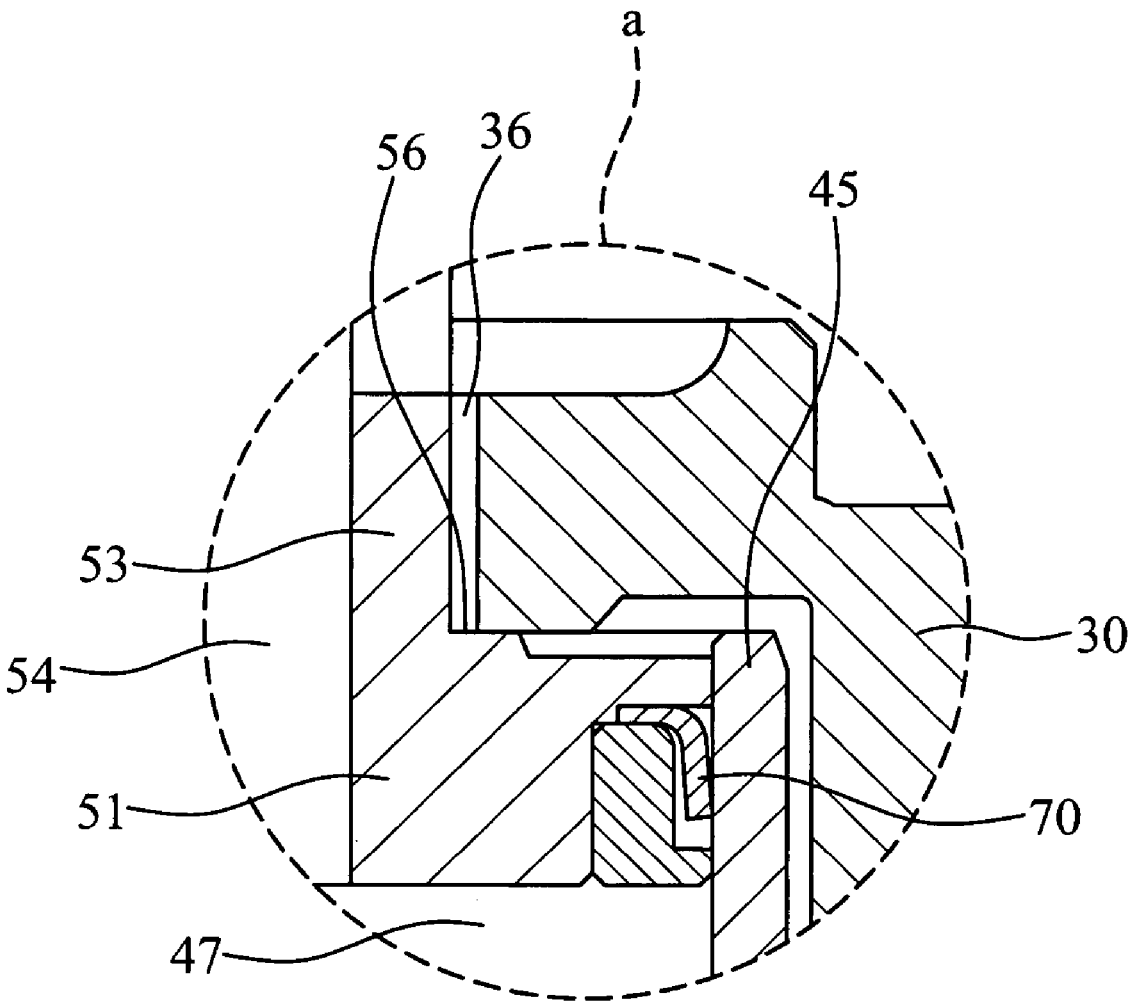
FIG. 1B is an enlarged view of the area a in FIG. 1A.

FIG. 1A shows a scroll compressor of the first embodiment during operation, and FIG. 1B shows the enlarged area a in FIG. 1A. The scroll compressor comprises a shell 10, a frame 20, a partition 30, and scroll couple 40 with a slider 50 disposed thereon. The shell 10 comprises an inlet 12 and outlet 14. The frame 20 is disposed in the shell 10, defining an inner space therebetween. The partition 30 with a central hole 38 is disposed in the inner space, forming a high-pressure chamber 32 and a low-pressure chamber 34. The scroll couple 40 is disposed in the low-pressure chamber 34 on the frame 20 and comprises an orbiting scroll 42 meshed with a non-orbiting scroll 41.

The slider 50 is received in a hub portion 45 in the center on the top of the non-orbiting scroll 41 and movable between a first position and a second position. The slider 50 comprises a cylindrical extending portion 53 with a venting passage 54 therein. The extending portion 53 protrudes into the high-pressure chamber 32 through the central hole 38 of the partition 30. The extending portion 53 of the slider 50 comprises a plurality of holes 55 on the side surface of the venting passage 54, thus communicating the discharge port 44 of the scroll couple 40 and the high-pressure chamber 32 through the venting passage 54. Furthermore, an enclosed space 47 is formed between the slider 50 and the non-orbiting scroll 41, such that the slider 50 is moved between a higher first position and a lower second position by the pressure variation of the enclosed space 47.

In this embodiment, the slider 50 further comprises a cylindrical first portion 51 with diameter thereof larger than that of the extending portion 53. The partition 30 of the scroll compressor comprises a plurality of discharge passages 36 around the side surface of the central hole 38, allowing communication between the high-pressure chamber 32 and the low-pressure chamber 34. The slider 50 further comprises a circular leak-proof surface 56 surrounding the outer bore of the extending portion 53. During operation of the scroll compressor, low-pressure work fluid therein passes through the inlet 12 and the intake port 43, entering the scroll couple 40, and is compressed thereby. Simultaneously, high-pressure work fluid is discharged through the discharge port 44 into the hub portion 45 of the non-orbiting scroll 41, raising the slider 50 to the first position as shown in FIGS. 1A and 1B. The circular leak-proof surface 56 of the slider 50 abuts the bottom surface around the central hole 38 of the partition 30 and seals the discharge passages 36, preventing leakage of high-pressure work fluid from the high-pressure chamber 32 to the low-pressure chamber 34 through discharge passages 36. Thus, the required operational pressure can be achieved quickly when the scroll compressor starts.

The slider 50 comprises a leak-proof member 70, such as an O-ring or Teflon ring, disposed around the outer bore of the first portion 51, abutting the inner surface of the hub portion 45, to prevent leakage of the work fluid from the gap between the slider 50 and the hub portion 45 to the low-pressure chamber 34.

In FIG. 1B, when the compression ratio of the scroll compressor exceeds a predetermined limit during operation, the slider 50 descends as the upward force provided by the discharging flow is lower than the downward force provided by the reverse flow corresponding to the weight of the slider 50. The work fluid in the high-pressure chamber 32 returns the low-pressure chamber 34 through the discharge passages 36 and the gap between the partition 30 and the non-orbiting scroll 41, such that pressure difference between the high-pressure chamber 32 and the low-pressure chamber 34 can be minimized.

Figure 1C:
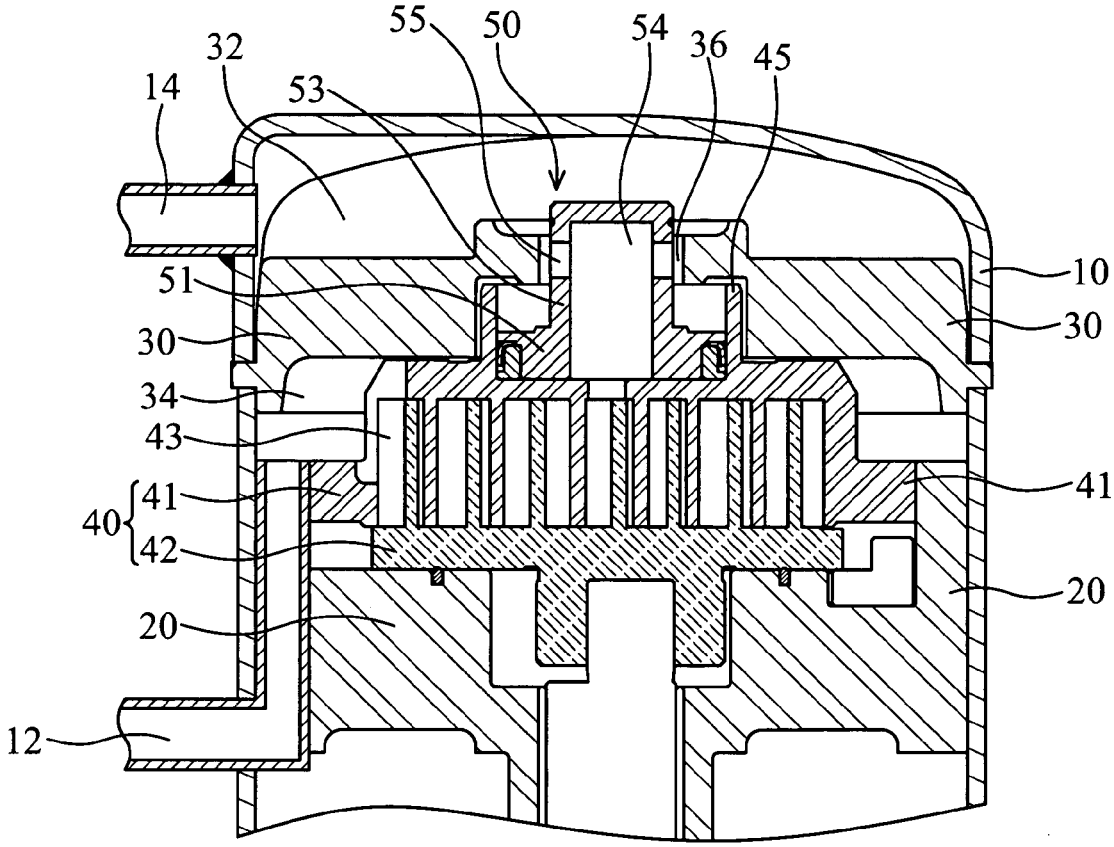
FIG. 1C is a partial cross section of the scroll compressor of the first embodiment when stopped.

FIG. 1C shows a partial cross section of the scroll compressor of the first embodiment when stopped. In FIG. 1C, the upward force provided by the discharging flow is eliminated when the scroll compressor stops. Therefore, the slider 50 immediately falls to the second position due to the downward force provided by the reverse flow corresponding to the weight of the slider 50. The partition 30 covers the holes 55 on the extending portion 53, thus reducing high-pressure backflow and preventing damage to the scroll couple 40. Furthermore, after the scroll compressor completely stops, the work fluid in the high-pressure chamber 32 can enter the low-pressure chamber 34 through the discharge passages 36, gradually balancing the pressure difference therebetween.

Second Embodiment

Figure 2:
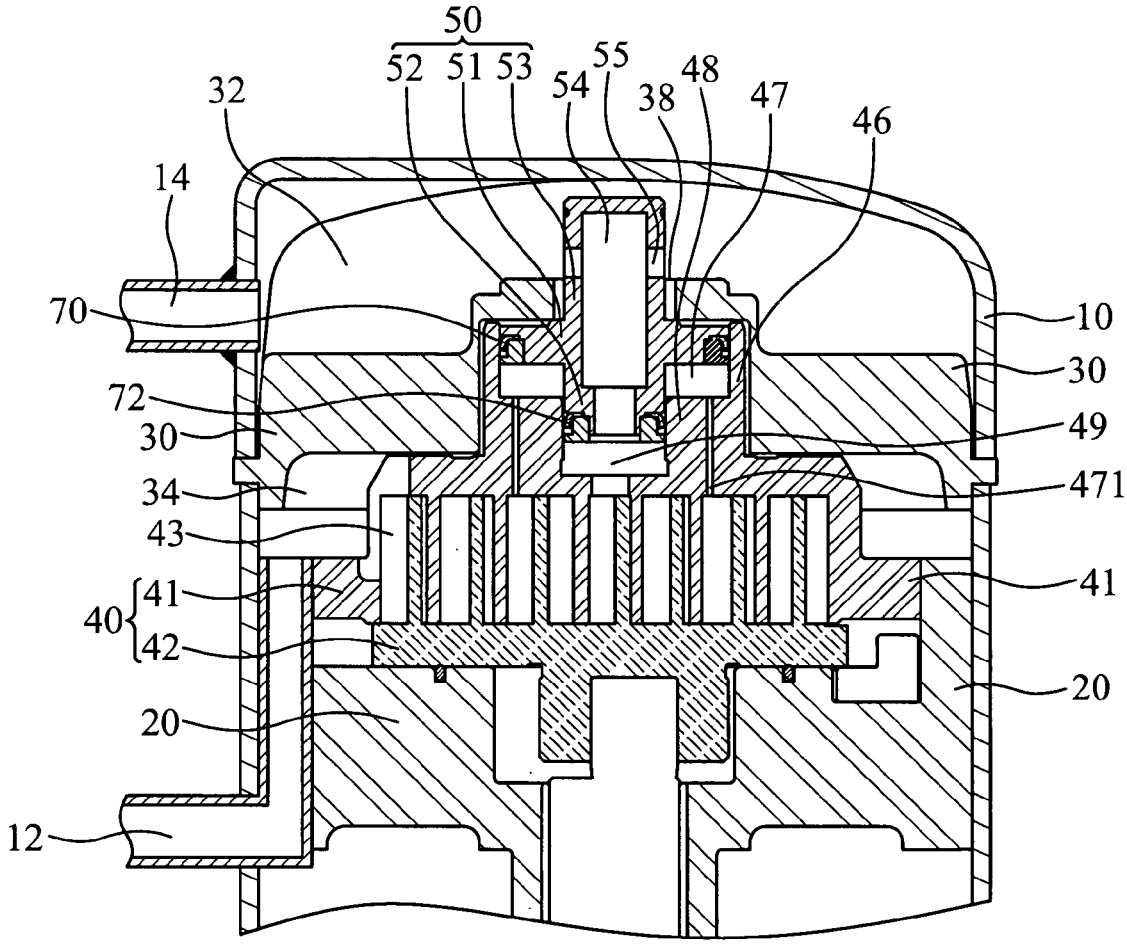
FIG. 2 is a partial cross section of a scroll compressor of the second embodiment during operation.

FIG. 2 shows a scroll compressor of the second embodiment during operation. In FIG. 2, the hub portion 45 of this embodiment comprises a first cavity 46 and a second cavity 48 beneath the first cavity 46. The diameter of the first cavity 46 is larger than that of the second cavity 48. The slider 50 comprises a cylindrical first portion 51 and a cylindrical second portion 52. The diameter of the first portion 51 is larger than that of the extending portion 53 and the second portion 52. When the slider 50 is disposed in the hub portion 45, the first portion 51 is received in the first cavity 46, and the second portion 52 is received in the second cavity 48. Two leak-proof members 70 and 72, such as O-rings or Teflon rings, are disposed around the outer bore of the first and second portions 51 and 52, abutting the inner surface of the hub portion 45. Therefore, two separated enclosed spaces 47 and 49 are defined between the slider 50 and the hub portion 45 of the non-orbiting scroll 41.

The non-orbiting scroll 41 of this embodiment comprises a plurality of bypasses 471 communicated with the first cavity 46. When the scroll compressor starts, work fluid passes through the bypasses 471, filling in the enclosed space 47, and assists in raising the slider 50 to the first position to rapidly establish required operational pressure.

Furthermore, when the compression ratio of the scroll compressor exceeds a predetermined limit during operation, or the scroll compressor stops, the work fluid in the high-pressure chamber 32 can enter the low-pressure chamber 34 through the discharge passages 36 and the gap between the partition 30 and the non-orbiting scroll 41, such that the pressure difference between the high-pressure chamber 32 and the low-pressure chamber 34 can be gradually balanced. Additionally, the slider 50 of this embodiment falls to the second position with the holes 55 on the extending portion 53 covered by the partition 30 when the scroll compressor stops, thus reducing high-pressure backflow and preventing damage to the scroll couple 40.

Third Embodiment

Figure 3A:
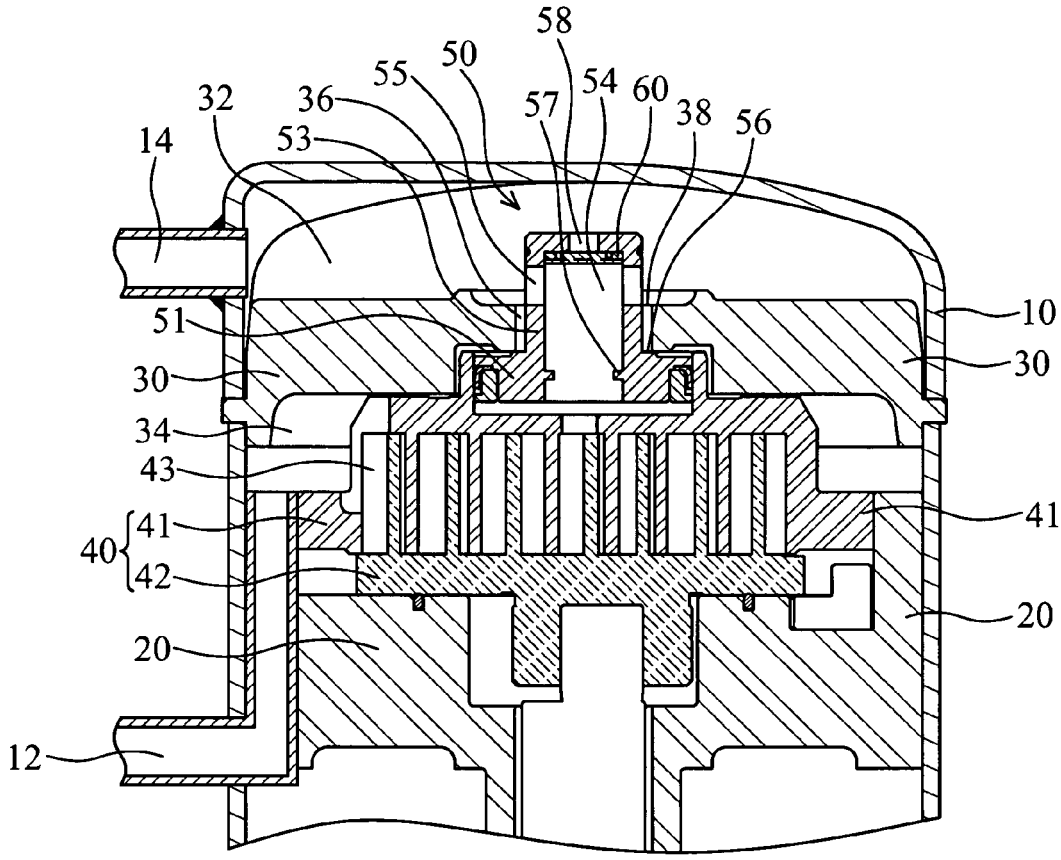
FIG. 3A is a partial cross section of a scroll compressor of the third embodiment during operation.
Figure 3B:
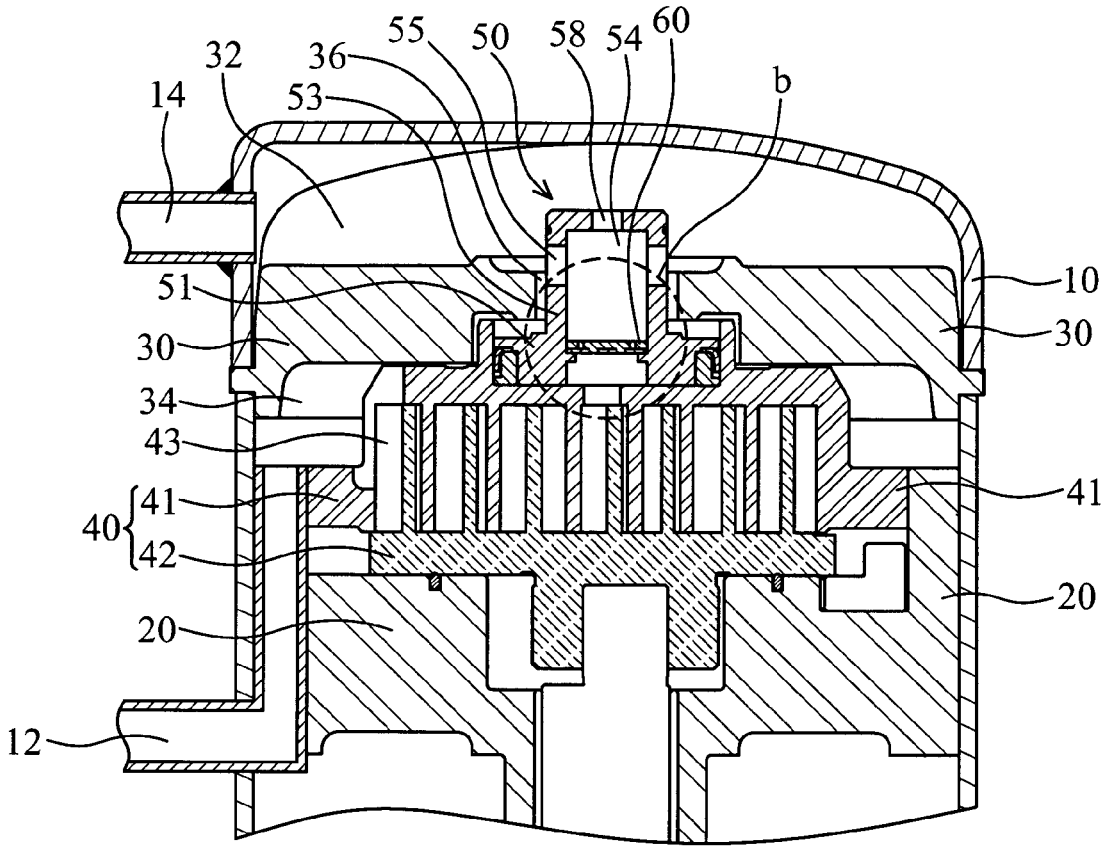
FIG. 3B is a partial cross section of the scroll compressor of the first embodiment when stopped.

FIG. 3A shows a scroll compressor of the third embodiment during operation, and FIG. 3B shows that when stopped. In FIGS. 3A and 3B, the movable region of the slider 50 is shorter than that in the first embodiment, such that the holes 55 on the extending portion 53 cannot be completely covered by the partition 30. Furthermore, the slider 50 of this embodiment comprises a floating element 60 movably disposed in a venting passage 54, a flange 57 around the side surface of the venting passage 54, restricting the floating element 60 therein, and a upper hole 58 on the top surface of the extending portion 53, communicating with the venting passage 54.

In this embodiment, during operation of the scroll compressor, high-pressure work fluid is discharged through the discharge port 44 into the hub portion 45 of the non-orbiting scroll 41 and raises the slider 50 and the floating element 60 to the position as shown in FIG. 3A. The circular leak-proof surface 56 of the slider 50 abuts the bottom surface around the central hole 38 of the partition 30 and seals the discharge passages 36, preventing leakage of high-pressure work fluid from the high-pressure chamber 32 to the low-pressure chamber 34 through discharge passages 36. Thus, the required operational pressure can be achieved quickly when the scroll compressor starts.

When the compression ratio of the scroll compressor of this embodiment exceeds a predetermined limit during operation, or the scroll compressor stops, the upward force provided by the discharging flow decreases. Therefore, the slider 50 and the floating element 60 immediately fall to the positions, shown in FIG. 3B, due to gravity and the downward force provided by the reverse flow. The work fluid in the high-pressure chamber 32 can enter the low-pressure chamber 34 through the discharge passages 36, gradually balancing the pressure difference therebetween.

Figure 3C:
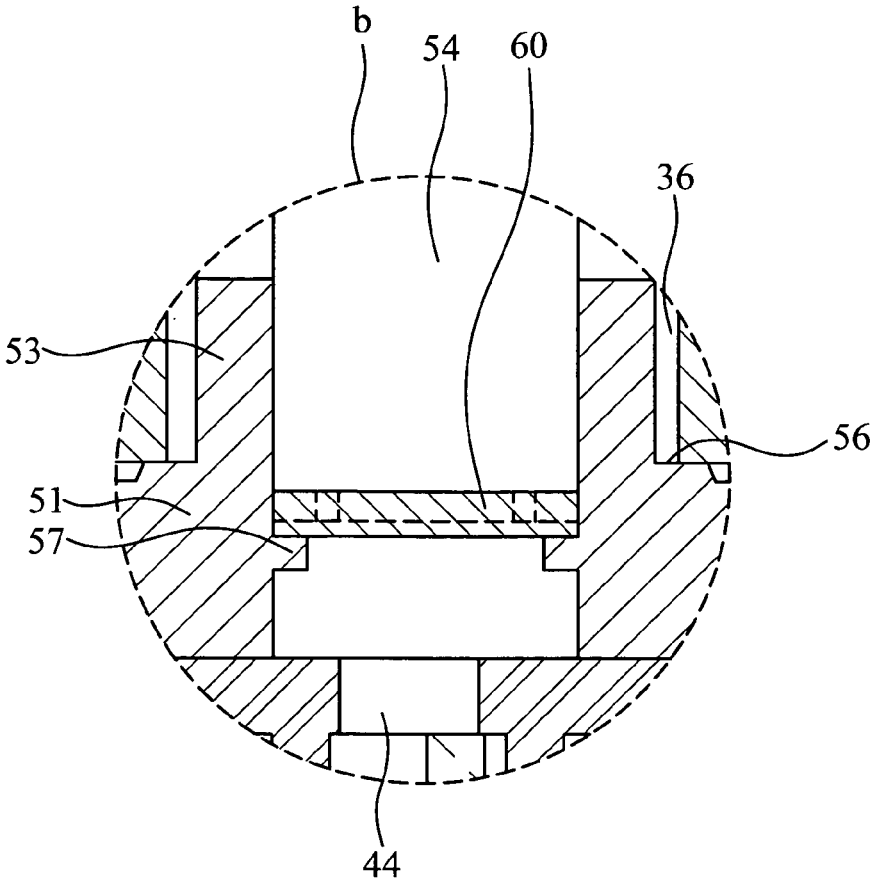
FIG. 3C is an enlarged view of the area b in FIG. 3B.
Figure 3D:
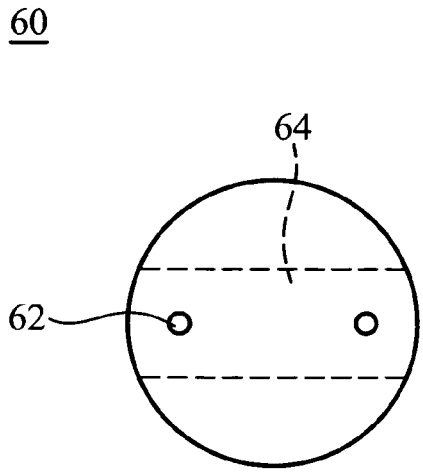
FIG. 3D is a top view of a floating element in FIG. 3B.

FIG. 3C is an enlarged view of the area b in FIG. 3B, and FIG. 3D shows is a top view of the floating element 60 in FIG. 3B. In FIGS. 3C and 3D, the floating element 60 comprises a groove 64 and two perpendicular second holes 62 communicated therewith. The floating element 60 is capable of preventing backflow when the scroll compressor stops and balancing the pressure difference between the high-pressure chamber 32 and the low-pressure chamber 34. Thus, the electrical discharge problems of the scroll couple 40 can be solved when recycling refrigerant.

Figure 3E:
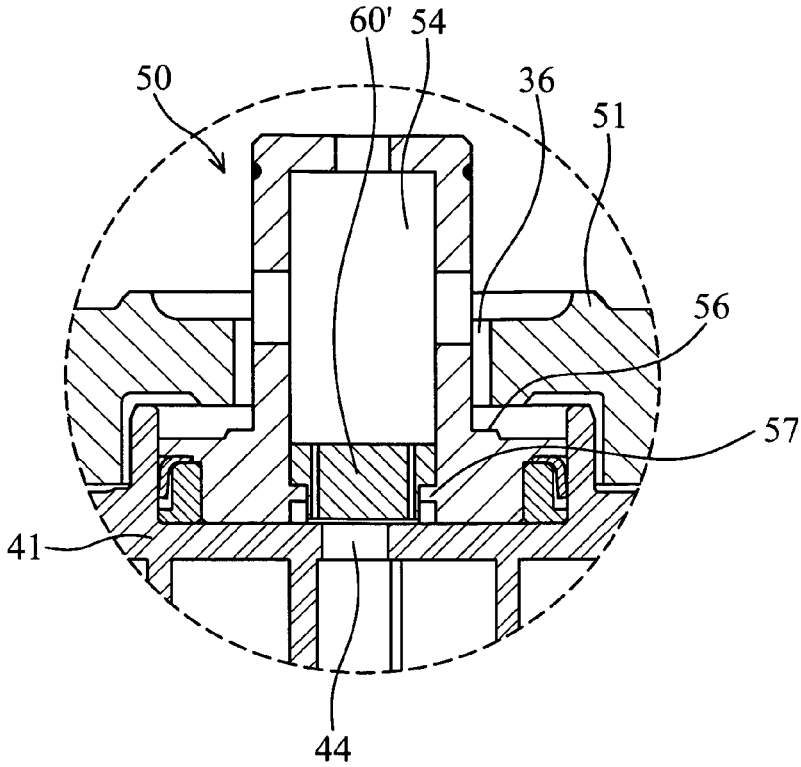
FIG. 3E is a cross section of another floating element.
Figure 3F:
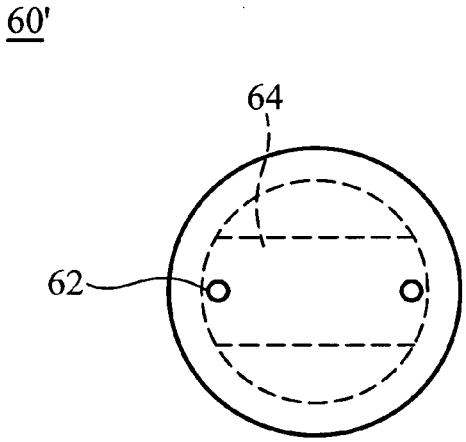
FIG. 3F is a top view of the floating element in FIG. 3E.

Furthermore, another floating element 60' is provided in FIGS. 3E and 3F. The floating element 60' comprises a downward protrusion, a groove 64 and two perpendicular second holes 62. When the scroll compressor stops, the downward protrusion of the floating element 60' directly blocks the discharge port 44 of the scroll couple 40 to prevent electrical discharge and backflow problems.

Fourth Embodiment

Figure 4:
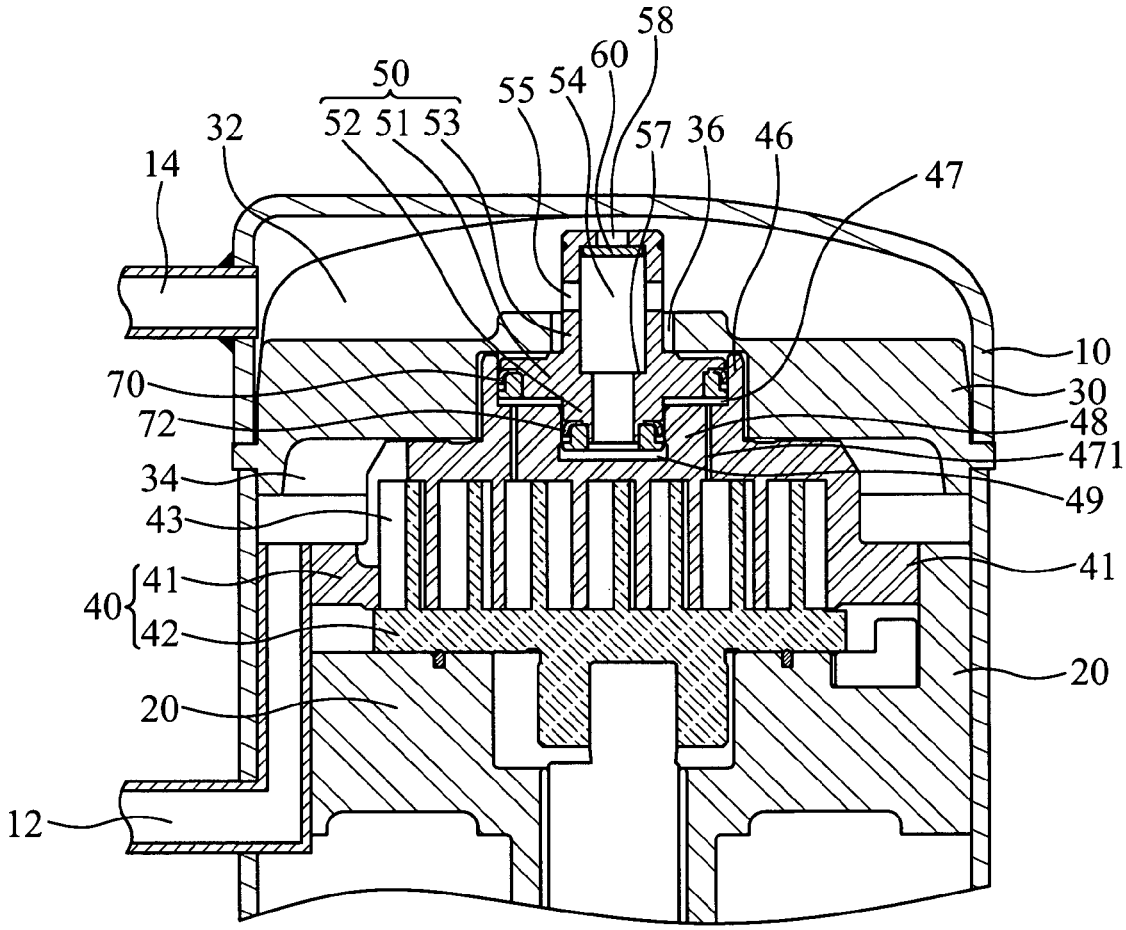
FIG. 4 is a partial cross section of a scroll compressor of the fourth embodiment during operation.

FIG. 4 shows a scroll compressor of the fourth embodiment during operation. Compared with the scroll compressor of the second embodiment in FIG. 2, the movable region of the slider 50 is shorter than that in the second embodiment, such that the holes 55 on the extending portion 53 cannot be completely covered by the partition 30. Furthermore, the slider 50 of this embodiment comprises a floating element 60 movably disposed in a venting passage 54, a flange 57 around the side surface of the venting passage 54, restricting the floating element 60 therein, and a upper hole 58 on the top surface of the extending portion 53, communicating with the venting passage 54.

The hub portion 45 of this embodiment comprises a first cavity 46 and a second cavity 48 beneath the first cavity 46. The diameter of the first cavity 46 is larger than that of the second cavity 48. The slider 50 comprises a cylindrical first portion 51 and a cylindrical second portion 52. The diameter of the first portion 51 is larger than that of the extending portion 53 and the second portion 52. When the slider 50 is disposed in the hub portion 45, the first portion 51 is received in the first cavity 46, and the second portion 52 is received in the second cavity 48. Two leak-proof members 70 and 72, such as O-rings or Teflon rings, are disposed around the outer bore of the first and second portions 51 and 52, abutting the inner surface of the hub portion 45. Therefore, two separated enclosed spaces 47 and 49 are defined between the slider 50 and the hub portion 45 of the non-orbiting scroll 41.

The non-orbiting scroll 41 of this embodiment comprises a plurality of bypasses 471 communicated with the first cavity 46. When the scroll compressor starts, work fluid passes through the bypasses 471, filling in the enclosed space 47, and assists in raising the slider 50 to the first position to rapidly establish required operational pressure.

Similar to the function of the third embodiment, the work fluid in the high-pressure chamber 32 can enter the low-pressure chamber 34 through the discharge passages 36 and the gap between the partition 30 and the non-orbiting scroll 41 when the compression ratio is exceeded during operation, or the scroll compressor stops. Additionally, the floating element 60 is also capable of preventing backflow.

Fifth Embodiment

Figure 5:
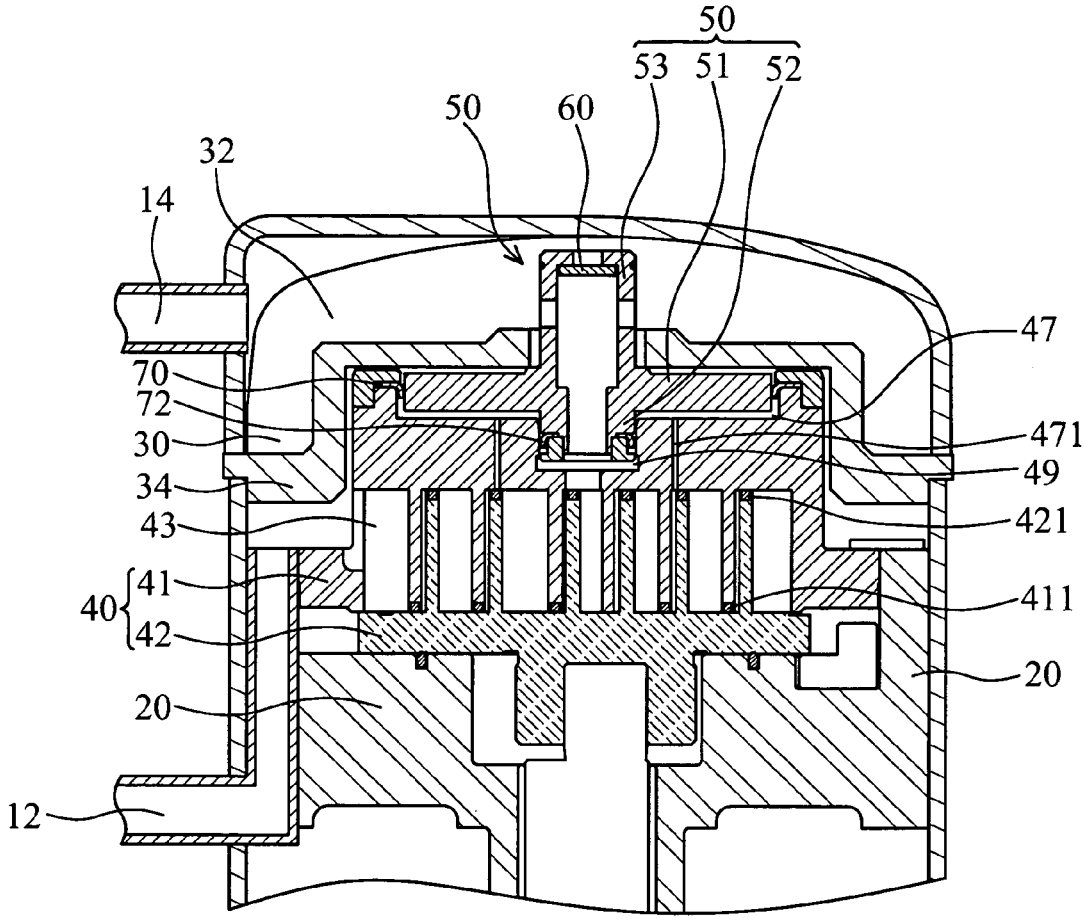
FIG. 5 is a partial cross section of a scroll compressor of the fifth embodiment during operation.

FIG. 5 shows a scroll compressor of the fifth embodiment during operation. In FIG. 5, the slider 50 of this embodiment comprises a disc-shaped first portion 51 with larger diameter than that of other embodiments. Thus, a larger downward force can be provided by the work fluid in the enclosed space 47, such that the scroll couple 40 can be tightly meshed during operation.

Furthermore, the scroll couple 40 of this embodiment comprises a plurality of gaskets 411, 421 on the top ends of each vane thereof, preventing leakage of compressed work fluid during revolution between the non-orbiting scroll 41 and the orbiting scroll 42.

The backflow-proof mechanism in each embodiment of the invention can prevent leakage of compressed work fluid from the high-pressure chamber 32 to the low-pressure chamber 34, such that the required operational pressure can be rapidly achieved when the scroll compressors start. The backflow-proof mechanisms also block the high-pressure backflow, preventing damage to the scroll couple 40 when the compressors suddenly stop. Furthermore, the backflow-proof mechanisms can balance the pressure difference between the high-pressure and low-pressure chambers 32 and 34 through discharge passages 36, which prevents electrical discharge between the scroll couple 40 when recycling refrigerant.

While the invention has been described by way of example and in terms of the preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A scroll compressor comprising:

a shell;

a frame disposed in the shell, forming an inner space therebetween;

a partition with a central hole disposed in the inner space, forming a high-pressure chamber and a low-pressure chamber;

a scroll couple disposed in the low-pressure chamber and comprising an orbiting scroll meshed with a non-orbiting scroll;

a slider movably disposed on the non-orbiting scroll between a first position and a second position and comprising an extending portion with a venting passage therein, wherein when the slider moves up to the first position, the extending portion protrudes into the high-pressure chamber through the central hole, connecting the high-pressure chamber and the scroll couple through the venting passage; and a plurality of enclosed spaces formed between the slider and the non-orbiting scroll, such that the slider is moved between the first position and the second position by the pressure variation of the enclosed spaces.

2. The scroll compressor as claimed in claim 1, wherein the non-orbiting scroll comprises a hub portion, receiving the slider.

3. The scroll compressor as claimed in claim 2, wherein the partition comprises a plurality of discharge passages around the side surface of the central hole, allowing communication between the high-pressure chamber and the low-pressure chamber.

4. The scroll compressor as claimed in claim 3, wherein the slider comprises a circular leak-proof surface surrounding the outer bore of the extending portion, sealing the discharge passages when the slider is in the first position and abuts the partition.

5. The scroll compressor as claimed in claim 3, wherein the extending portion of the slider comprises a plurality of first holes on the side surface of the venting passage, allowing communication between the high-pressure chamber and the venting passage.

6. The scroll compressor as claimed in claim 5, wherein the first holes are covered by the partition when the slider is in the second position.

7. The scroll compressor as claimed in claim 5, wherein the slider comprises a floating element movably disposed in the venting passage.

8. The scroll compressor as claimed in claim 7, wherein the slider comprises a flange around the side surface of the venting passage, restricting the floating element therein.

9. The scroll compressor as claimed in claim 7, wherein the floating element comprises a groove and a plurality of perpendicular second holes communicated therewith.

10. The scroll compressor as claimed in claim 7, wherein the scroll couple comprises a discharge port, and the floating element covers the discharge port when the slider is in the second position with the hub portion of the scroll couple.

11. The scroll compressor as claimed in claim 7, wherein the extending portion comprises a third hole communicated with the venting passage.

12. The scroll compressor as claimed in claim 2, wherein the hub portion comprises a first cavity and a second cavity, the first cavity is above the second cavity, and the diameter of the first cavity is larger than the diameter of the second cavity.

13. The scroll compressor as claimed in claim 12, wherein the slider comprises a first portion and a second portion, the first portion is above the second portion, and the diameter of the first portion is larger than the diameter of the second portion.

14. The scroll compressor as claimed in claim 13, wherein the diameter of the first portion is larger than the diameter of the extending portion.

15. The scroll compressor as claimed in claim 13, wherein the slider is disposed in the hub portion with the first portion in the first cavity and the second portion in the second cavity, forming the enclosed spaces therebetween.

16. The scroll compressor as claimed in claim 15, wherein the non-orbiting scroll comprises a plurality of bypasses communicated with the first cavity.

17. The scroll compressor as claimed in claim 2, wherein the slider comprises a plurality of leak-proof members disposed around its outer bore, abutting the inner surface of the hub portion.

18. The scroll compressor as claimed in claim 17, wherein the leak-proof members are O-rings.

19. The scroll compressor as claimed in claim 17, wherein the leak-proof members are Teflon rings.

20. A scroll compressor comprising:

a shell;

a frame disposed in the shell, forming an inner space therebetween;

a partition with a central hole disposed in the inner space, forming a high-pressure chamber and a low-pressure chamber;

a scroll couple disposed in the low-pressure chamber and comprising an orbiting scroll and a non-orbiting scroll with a hub portion;

a slider movably disposed in the hub portion of the non-orbiting scroll and comprising an extending portion with a venting passage therein, wherein the extending portion comprises a plurality of first holes on the side surface of the venting passage and protrudes into the high-pressure chamber through the central hole, allowing communication between the high-pressure chamber and the scroll couple through the venting passage when the slider is in a first position; and wherein the first holes are covered by the partition when the slider is in a second position.

21. The scroll compressor as claimed in claim 20, wherein a plurality of enclosed spaces is formed between the slider and the hub portion, such that the slider is moved between the first position and the second position by the pressure variation of the enclosed spaces.

22. The scroll compressor as claimed in claim 20, wherein the partition comprises a plurality of discharge passages around the side surface of the central hole, allowing communication between the high-pressure chamber and the low-pressure chamber.

23. The scroll compressor as claimed in claim 20, wherein the slider comprises a circular leak-proof surface surrounding the outer bore of the extending portion, sealing the discharge passages when the slider is in the first position and abuts the partition.

24. The scroll compressor as claimed in claim 20, wherein the hub portion comprises a first cavity and a second cavity, the first cavity is above the second cavity, and the diameter of the first cavity is larger than the diameter of the second cavity.

25. The scroll compressor as claimed in claim 24, wherein the non-orbiting scroll comprises a plurality of bypasses communicated with the first cavity.

26. The scroll compressor as claimed in claim 24, wherein the slider comprises a first portion and a second portion, the first portion is above the second portion, and the diameter of the first portion is larger than the diameter of the second portion.

27. The scroll compressor as claimed in claim 24, wherein the diameter of the first portion is larger than the diameter of the extending portion.

28. The scroll compressor as claimed in claim 24, wherein the first portion is received in the first cavity, and the second portion is received in the second cavity.

29. The scroll compressor as claimed in claim 20, wherein the slider comprises a plurality of leak-proof members disposed around the outer bore thereof, abutting the inner surface of the hub portion.

30. The scroll compressor as claimed in claim 29, wherein the leak-proof members are O-rings.

31. The scroll compressor as claimed in claim 29, wherein the leak-proof members are Teflon rings.

* * * * *